US007549823B2

(12) United States Patent
Hermes et al.

(10) Patent No.: US 7,549,823 B2
(45) Date of Patent: Jun. 23, 2009

(54) KING PILE FOR A SUPPORT WALL CURTAIN

(75) Inventors: Aloyse Hermes, Differdange (LU); Maro Widong, Esch sur Alzette (LU)

(73) Assignee: Arcelormittal Belval & Differdange, Esch-sur-Alzette (LU)

( * ) Notice: Subject to any disclaimer, the term of this patent is extended or adjusted under 35 U.S.C. 154(b) by 299 days.

(21) Appl. No.: 10/575,678

(22) PCT Filed: Oct. 14, 2004

(86) PCT No.: PCT/EP2004/052549

§ 371 (c)(1),
(2), (4) Date: Apr. 13, 2006

(87) PCT Pub. No.: WO2005/038148

PCT Pub. Date: Apr. 28, 2005

(65) Prior Publication Data

US 2007/0077129 A1 Apr. 5, 2007

(30) Foreign Application Priority Data

Oct. 14, 2003 (LU) ..... 91043

(51) Int. Cl.
*E02D 5/08* (2006.01)
*E02D 5/02* (2006.01)

(52) U.S. Cl. ..... 405/277

(58) Field of Classification Search ..... 405/274, 405/276, 277, 279

See application file for complete search history.

(56) References Cited

U.S. PATENT DOCUMENTS

| | | | | | |
|---|---|---|---|---|---|
| 1,835,367 | A | * | 12/1931 | Becker et al. | 405/277 |
| 2,093,208 | A | * | 9/1937 | Nolte | 29/897.3 |
| 4,550,582 | A | | 11/1985 | Ehiro et al. | |
| 4,917,543 | A | * | 4/1990 | Cole et al. | 405/262 |

FOREIGN PATENT DOCUMENTS

| | | |
|---|---|---|
| DE | 583 471 | 9/1933 |
| DE | 627 738 | 11/1937 |
| DE | 103 39 957 B3 | 1/2005 |
| JP | 62-133209 A | 6/1987 |
| JP | 2000-73361 A | 3/2000 |

* cited by examiner

*Primary Examiner*—Sunil Singh
(74) *Attorney, Agent, or Firm*—The Nath Law Group; Jerald L. Meyer; Sungyeop Chung

(57) ABSTRACT

The inventive girder (10) for a support wall curtain comprises a core (12) and two parallel wings (14, 16) which are supported by said core and provided with connection means (20). Said wings (14, 16) are reinforced on the largest part of the width thereof on the side opposite to the core (12) by an excessive material thickness which starts only at a certain distance ($d_1$) from the longitudinal edges of the wing, thereby leaving the thinner wing ends (21) carrying said connection means (20) free. The non-reinforced ends (21) of the wings make it possible to use a conventional connection systems (18) in order to integrate such a girder (10) provided with a high resistant module into the support wall curtains.

13 Claims, 4 Drawing Sheets

KING PILE FOR A SUPPORT WALL CURTAIN

The present invention concerns a king pile for a retaining wall and a retaining wall comprising such king piles.

PRIOR ART

Retaining walls formed either exclusively of king piles or of king piles and sheet piles have been long known. They have the advantage of possessing very high strength moduli for an advantageous weight per unit area. Interlocks between two king piles or between a king pile and a sheet pile are formed at the edges of the king pile flanges.

PROFILARBED S.A. (Luxembourg) markets, under the reference "HZ", an integrated system for building retaining walls. This integrated system comprises special king piles, called HZ king piles. The edge of the flanges of these HZ king piles terminates with an enlargement of approximately triangular cross section, which projects from the flange external surface. An RH-type or an RZ-type interlock section can be threaded onto this enlarged flange edge to allow another HZ king pile or an AZ sheet pile to be interlocked.

It has also been known to cold form the flange edges of the king pile to give them a corrugated profile. An interlock section can then be threaded onto such a corrugated edge to allow either another flange edge of a king pile or a sheet pile claw to be interlocked therewith. Such a system is, for example, described in patent application EP-A-0072118.

It has also been known to weld sheet pile claws to the flange edges of the king pile to interlock sheet piles therewith.

Today, retaining walls are needed with increasingly high strength moduli. One method of increasing significantly the strength modulus of a king pile is to increase the depth of its web. However, the maximum depth of the king pile web is naturally determined by the width of the rolling mill train. As a result, new, wider rolling mill trains should be built to roll deeper king piles. Another method of increasing the strength modulus of king piles is to increase the thickness of their flanges. However, this would mean designing new connection systems for thick flanges.

A connection system for king piles with thick flanges is known from document DE 583 471. This involves shallow king piles with the web depth equaling the flange width, which can be installed in the retaining wall with their web either perpendicular or parallel to the wall axis. One flange of this king pile comprises a groove along each longitudinal edge rolled or machined into the internal surface of the flange and a bearing rolled or machined into the lateral edge of the flange. The groove and the bearing allow the ends of the flanges of two adjacent king piles to be connected using special interlock sections and a flange of a first king pile to be transversely connected between the two flanges of a second king pile. This then forms a very special connection system, designed in 1927 for special implementation of shallow king piles and which was probably never successful.

Document U.S. Pat. No. 4,550,582 describes a method of rolling king piles with claws for retaining walls. During rolling, additional interlocking devices, capable of engaging in the same way as LARSEN interlocks known for sheet piles, are formed along the flange edges. A first type of interlocking device comprises a "bent finger" and a "thumb" defining an interlocking recess. A second type of interlocking device comprises an enlargement suitable for reception in the interlocking recess. A projection, to which several functions are allocated, is formed along said second type of interlocking device. A first function would be to increase the stability of a stack of king piles. The king pile lying on one flange rests effectively on said projection and on said first type of interlocking device, which is of approximately the same height as said projection. A second function would be to form a bearing for a guiding device, when driving a king pile into the ground. A third function would be to balance the flange transverse cross sections with respect to the web. Finally, it should also be noted that said projection would increase the section modulus of the king pile. However, rolling such claws and projections is a difficult operation and virtually impossible for a king pile with flanges exceeding 22 mm thick. Furthermore, construction practice has yet to prove this new connection system on site.

SUMMARY OF THE INVENTION

The object of the present invention is to propose a king pile, capable of being easily rolled, featuring a high strength modulus without having to increase significantly its depth, which can be implemented in retaining walls by resorting to different connection systems, which have been proven on site.

This object is achieved by a king pile for retaining walls, whose flanges are fitted with connection means along their longitudinal edges, characterized in that these flanges are strengthened, on the side opposite the web over the major part of their width, by an extra material thickness, which starts only at a certain distance from the longitudinal edges of the flange, allowing the flange ends of smaller thickness, carrying the connection means, to remain. Strengthening of the flanges by an extra material thickness over a local area opposite the web allows the king pile strength modulus to be significantly increased without a notable increase in its depth. On the other hand, the unstrengthened flange ends, whose thickness is comparable with the flange thickness of a conventional king pile for retaining walls, allow virtually all known connection systems for integrating a king pile into a retaining wall to be used.

In a first embodiment, the connection means carried by the flange ends comprise an interlocking enlargement. A king pile of this type can, for example be easily integrated into a retaining wall using connection devices comparable with "RH"-type or "RZ"-type interlock sections of the PROFILARBED S.A. "HZ" system. It will be noted that the maximum extra material thickness is preferably greater than the height of the enlargement, such that the enlargement is set back from a bearing surface formed by the extra material thickness of the flange. It remains to be noted that, for "RH"-type or "RZ"-type interlock sections, the enlargement of the flange must be of triangular cross section. However, designing of interlock sections requiring an interlocking enlargement of a different cross section is not excluded.

In another embodiment, at least one of the flange ends of smaller thickness has a corrugated longitudinal profile to form the connection means directly. A king pile of this type can, for example, be easily integrated into a retaining wall such as the one described in patent application EP-A-0072118.

The connection means can also comprise an interlock section, for a sheet pile, which is welded end to end on a lateral face of one of the flange ends of smaller thickness. Such an interlock section for a sheet pile can also be carried by a U-shaped section threaded onto one of the flange ends of smaller thickness and fixed to this flange end by two corner welds.

The extra material thickness is preferably symmetrical about the mid-plane of the web. To facilitate rolling of the king pile, the extra material thickness on the flange is advantageously divided in two by a longitudinal groove running above the web.

The ratio of the thickness of said flange ends to the thickness of the web is preferably between 1.0 and 1.7. The ratio of the maximum thickness of the flange at the extra material thickness to the thickness of the flange ends is preferably between 1.5 and 4.0. The thickness of the flange ends will be preferably between 10 mm and 25 mm. If the maximum thickness of a flange at the extra material thickness is between 40 mm and 60 mm, setting back of the retaining wall connections with respect to the bearing surfaces formed by the extra material thicknesses will be most often ensured.

Above all, the present invention is advantageous for increasing the strength modulus of a deep king pile, in other words for which the ratio of the web depth (H) to the flange width (B) is greater than 2, because it allows a significant increase in its strength modulus to be obtained without a significant additional increase in its depth.

In a retaining wall according to the invention, at least two king piles according to the invention are connected at their flanges by interlock sections. The extra material thicknesses advantageously form bearing surfaces, which define a bearing plane located in front of the interlock sections (in other words, the interlock sections are located set back with respect to the bearing plane defined by the extra material thicknesses of the flanges). A wale can then bear directly on the bearing surfaces formed by the extra material thicknesses without being obstructed by the interlock sections.

BRIEF DESCRIPTION OF THE DRAWINGS

Advantageous embodiments of the present invention are described on the basis of the appended drawings, in which.

DESCRIPTION OF A PREFERRED EMBODIMENT

Figure 1:
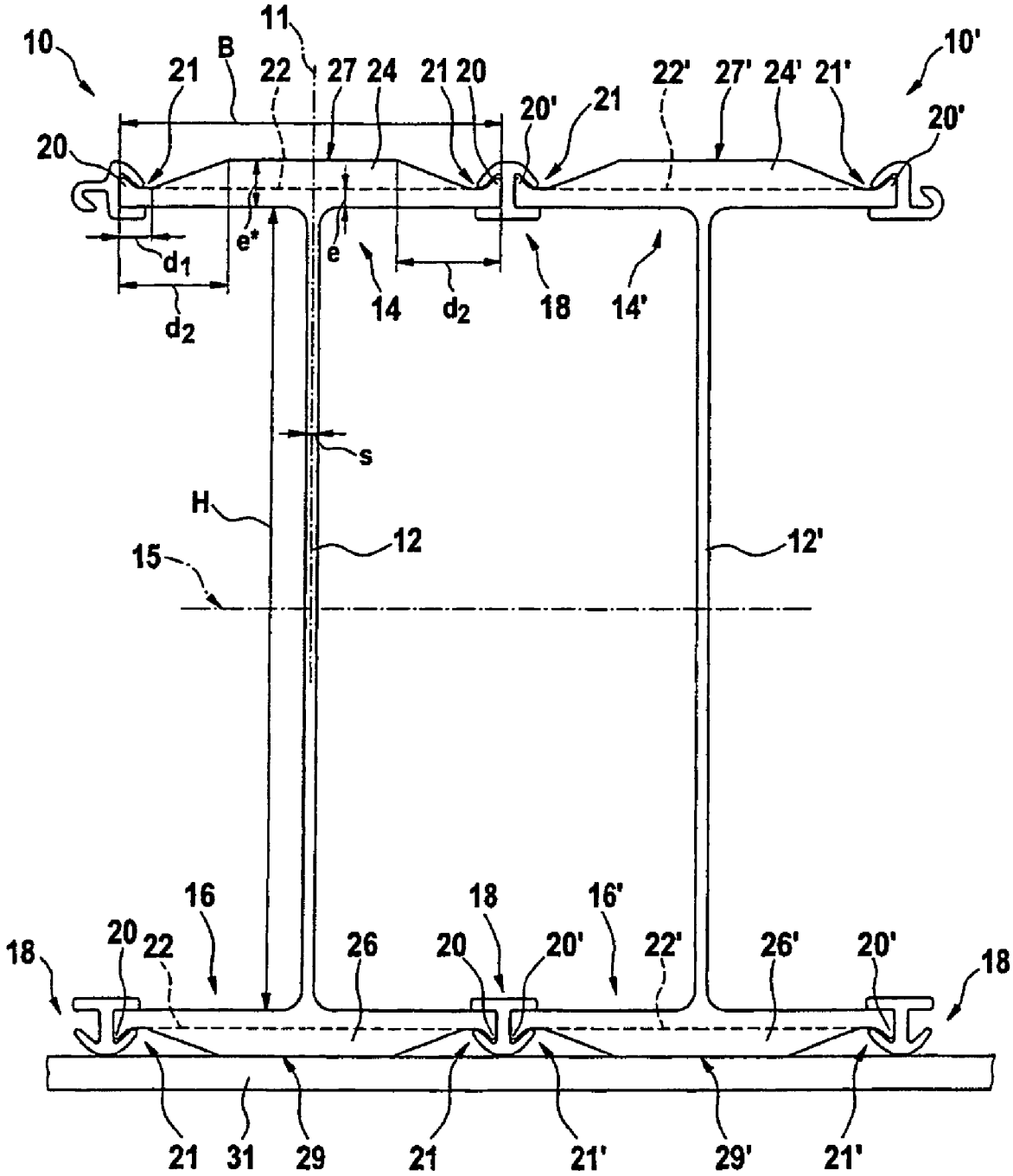
FIG. 1: is a view of a pair of king piles connected at their adjacent flanges.

FIG. 1 shows two interconnected king piles 10, 10'. Such a king pile 10, 10' comprises a web 12, 12' and two flanges 14, 16, 14', 16'. The web 12, 12' supports the flanges 14, 16, 14', 16' such that the cross section of the king pile 10, 10' takes the shape of a Roman numeral I with a first plane of symmetry formed by the mid-plane 11 of the web 12, 12' and a second plane of symmetry 15, which is perpendicular to the mid-plane of the web 12, 12'. The depth H of the web 12, 12' is approximately twice the width B of the flange 14, 16, 14', 16'.

The two king piles are connected at their flanges 14, 16, 14', 16' using intrinsically known interlock sections 18, for example using RH interlocks marketed by PROFILARBED S.A. (Luxembourg). The flanges 14, 16, 14', 16' include, along each longitudinal edge, an enlargement 20, 20' of approximately triangular cross section. The interlock section 18 is threaded onto these longitudinal edges of the flanges 14, 16, 14', 16' such that the interlocking enlargements 20 engage with the interlock recesses of the interlock sections 18. This connection method is well known and is widely used for building retaining walls.

Figure 5:
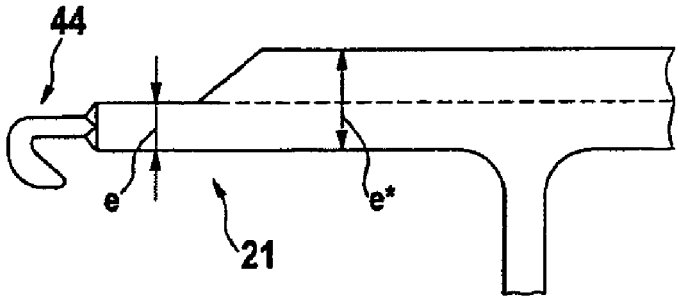
FIG. 5: is a diagrammatic detail of a third embodiment of a flange end of a king pile with a claw for connecting a sheet pile therewith.
Figure 8:
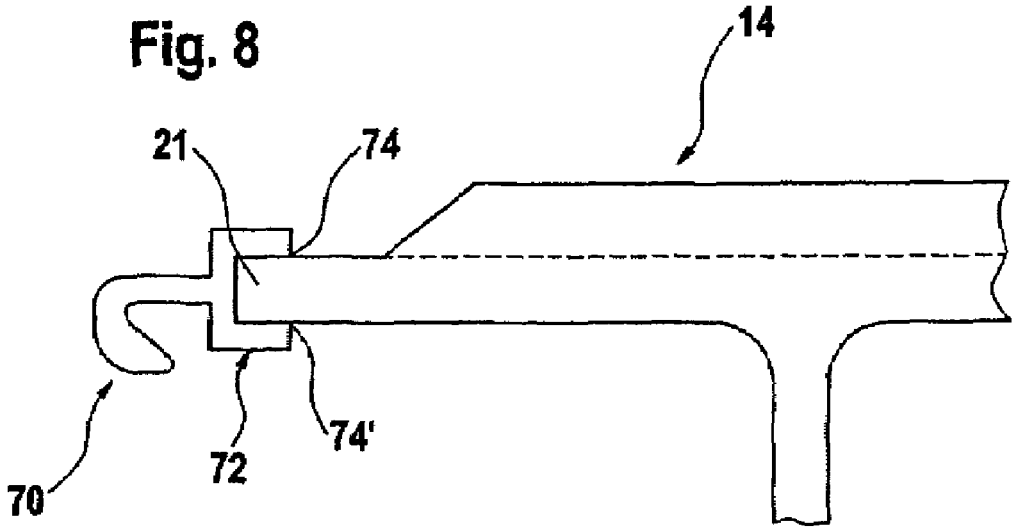
FIG. 8: is a diagrammatic detail of a fourth embodiment of a flange end of a king pile with a welded interlock equipped with a sheet pile claw.

In FIG. 1, the broken lines 22, 22' represent the outline of the external face of the flanges of a conventional HZ king pile produced by PROFILARBED S.A. (Luxembourg). We see that in the new king piles 10, 10', the two flanges 14, 16, 14', 16' are strengthened on the side opposite the web by an extra material thickness 24, 26, 24', 26', which starts only at a certain distance from the edges of the flange. At a certain distance $d_1$ from the flange edge, the thickness of the flange increases gradually to reach a maximum value e* at a distance $d_2$ from the edge ($d_1<d_2$). The thickness of the flange 14 then remains equal to e* up to a distance $d_2$ from the opposite edge of the flange, before decreasing symmetrically with respect to the mid-plane of the web 12, 12'. The extra material thicknesses 24, 26, 24', 26' therefore allow flange ends 21, 21', of approximately the same thickness e as the flanges of a conventional HZ king pile, to remain. These flange ends 21 carry the interlocking enlargements 20 or other connection means respectively (c.f. FIGS. 5 and 8). In the embodiment shown, the thickness e* is approximately twice the thickness e of the flange ends 21. In practice, this ratio can vary between 1.5 and 4.0. However, it will be noted that a thickness e* of the order of 50 mm allows the extra material thicknesses 24, 26, 24', 26' to define bearing surfaces 27, 29, 27', 29' located in front of the interlock sections 18. In FIG. 1, we therefore see a wale 31 bearing on the bearing surfaces 29, 29' without being obstructed by the interlock sections 18 connecting the flanges 26 and 26'. The thickness e of the flange ends 21 is usually between 10 mm and 25 mm. The ratio of the thickness e of the flange ends 21 to the thickness of the web 12 is usually between 1.0 and 1.7. A new king pile 10, 10' can easily have a strength modulus, which is at least 50% higher than that of an equivalent conventional HZ king pile.

Figure 2:
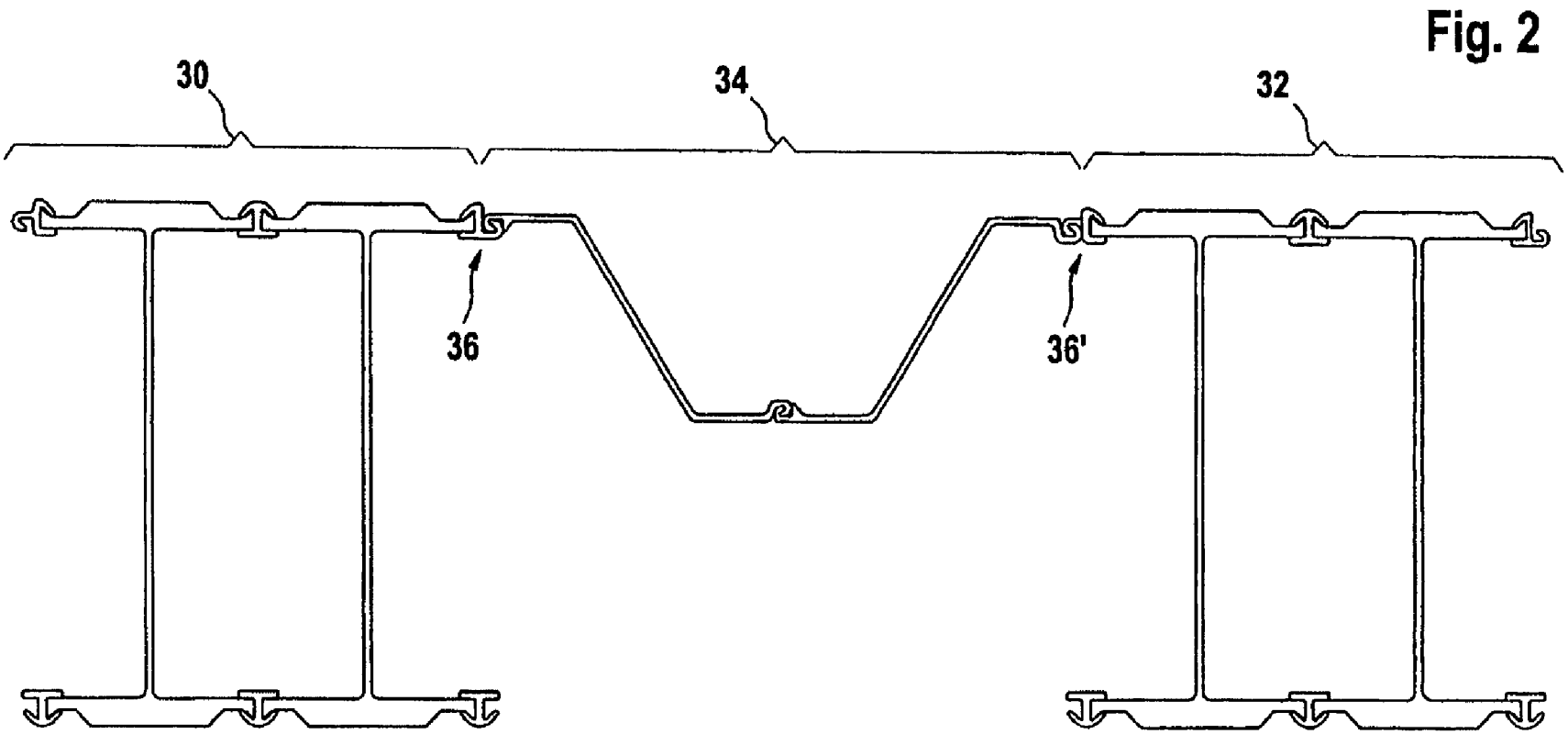
FIG. 2: is a view of a combined retaining wall comprising two pairs of king piles according to FIG. 1 and one pair of Z-shaped sheet piles connecting the two pairs of king piles.

FIG. 2 shows how two pairs 30, 32 of these king piles 10, 10' can form, with a pair 34 of Z sheet piles, a combined retaining wall. Interlock sections 36, 36', suitable for connecting the sheet piles 34 to the flanges of the king piles 30, 32 are, for example, those marketed by PROFILARBED S.A. (Luxembourg) under the names RZ-U interlock and RZ-D interlock respectively. We also see that these interlocks are all slightly set back from the bearing surfaces formed by the extra material thicknesses on the flanges of the king piles.

Figure 3:
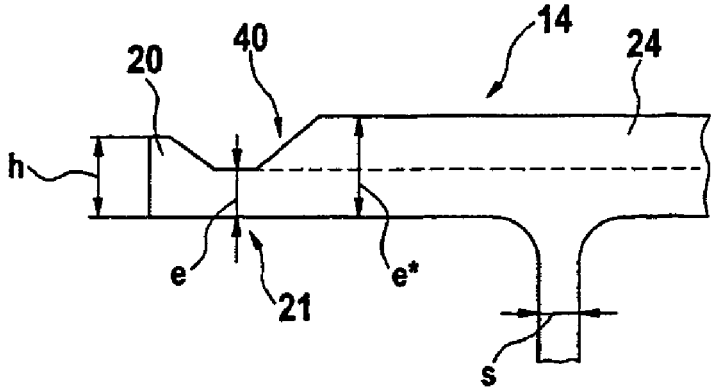
FIG. 3: is a diagrammatic detail of a first embodiment of a flange end of a king pile.
Figure 4:
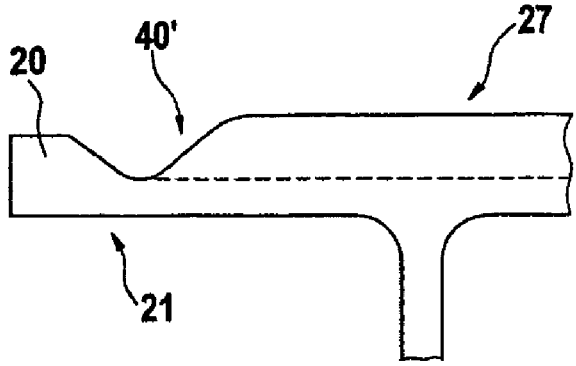
FIG. 4: is a diagrammatic detail of a second embodiment of a flange end of a king pile.

FIG. 3 shows a diagrammatic detail of a first embodiment of a flange end of a king pile. In particular, we see that the height h of the enlargement 20 is smaller than the strengthened thickness e* of the flange 14. We also note that the extra material thickness 24 starts with a slope 40. In FIG. 4, the connections between the slope 40' and the enlargement 20 at the flange end 21 are rounded, as is the connection between the slope 40' and the bearing surface 27.

FIG. 5 shows a flange end 21 of a king pile without interlocking enlargements. An interlock section 44 for a sheet pile is welded end to end onto the lateral face of the flange end 21.

We note that the end-to-end welding operation would be much more difficult if the flange end 21 were also of thickness e*.

Figure 6:
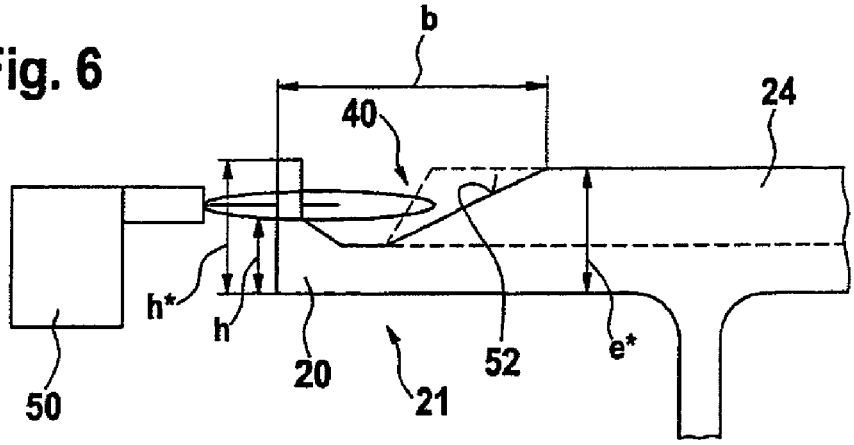
FIG. 6: is a diagrammatic detail showing fine finishing of a flange end of a king pile with an enlargement.

FIG. 6 is a diagrammatic detail showing the fine finishing of an interlocking enlargement 20. On leaving the rolling mill, the height h* of the interlocking enlargement 20 is approximately the same as the thickness e*. A cutting torch 50 then gives the interlocking enlargement 20 its final height h, which is smaller than the thickness e* of the strengthened flange. FIG. 6 shows that the width b of the groove 40 must be such that the flame of the cutting torch 50 cannot burn the sloping flank 52 of the extra material thickness 24.

Figure 7:
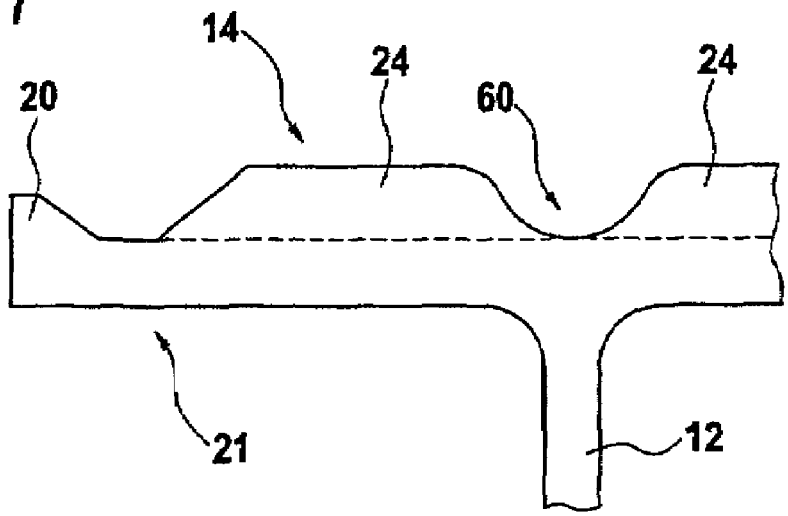
FIG. 7: is a diagrammatic detail of an alternative embodiment of FIG. 3.

The embodiment shown in FIG. 7 differs from the embodiment shown in FIG. 3 in that the extra material thickness 24 is divided in two by a longitudinal groove 60 running above the web 12. This longitudinal groove 60 facilitates rolling of the king pile because it allows better guidance of the king pile in the rolling mill.

The embodiment shown in FIG. 8 differs from the embodiment shown in FIG. 5 in that a U-shaped section 72, which is threaded onto the flange end 21, carries a sheet pile interlock 70. This U-shaped section 72 is then fixed to the flange end 21 by two corner welds 74, 74'.

Figure 9:
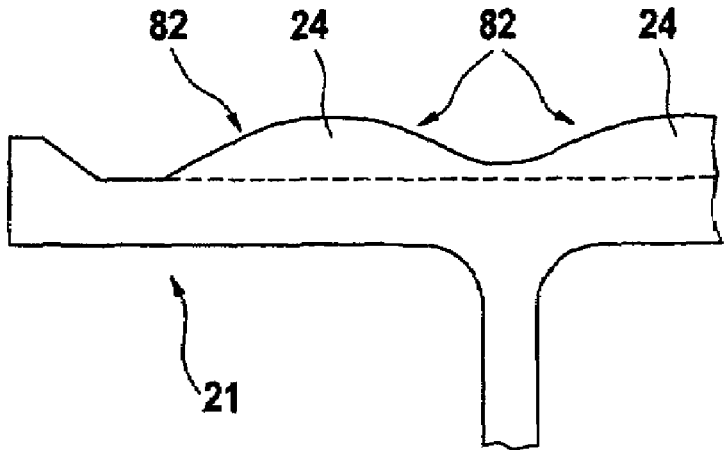
FIG. 9: is a diagrammatic detail of an alternative embodiment of FIG. 3.

FIG. 9, like FIG. 7, shows an embodiment in which the extra material thickness 24 is divided in two by a longitudinal groove 60 running above the web 12. This embodiment is distinguished by curved connection surfaces 80, 82.

The invention claimed is:

1. A retaining wall, comprising:

at least two king piles, each of said king piles comprising a web and two parallel flanges carried by the web, said flanges being fitted with connection means along their longitudinal edges, wherein said flanges are reinforced, on the side opposite the web over the major part of their width, by an extra material thickness, which starts with a slope only at a certain distance from the longitudinal edges of the flange, so that said flange has flange ends of smaller thickness, said connection means being carried by said flange ends of samller thickness;

at least one interlock section connecting said at least two king piles by their connection means at their flanges, wherein said extra material thicknesses of said reinforced flanges are dimensioned to form bearing surfaces, in front of said interlock sections; and at least one wale bearing on said bearing surfaces formed by said extra material thicknesses in front of said interlock sections.

2. The retaining wall according to claim 1, wherein said connection means comprises an enlargement of triangular cross section, which is carried by one of said flange ends of smaller thickness.

3. The retaining wall according to claim 2, wherein the maximum thickness of said extra material thickness is greater than the height of said enlargement.

4. The retaining wall according to claim 1, wherein at least one of said flange ends of smaller thickness has a corrugated longitudinal profile to form said connection means.

5. The retaining wall according to claim 1, wherein said connection means comprises an interlock section for a sheet pile, which is welded end to end on a lateral face of one of said flange ends of smaller thickness.

6. The retaining wall according to claim 1, wherein said connection means comprises an interlock section for a sheet pile, which is carried by a U-shaped section threaded onto one of said flange ends of smaller thickness, said U-shaped section being fixed to said flange end by two corner welds.

7. The retaining wall according to claim 1, wherein said extra material thickness on a flange is divided in two by a longitudinal groove running above the web.

8. The retaining wall according to claim 1, wherein said extra material thickness is symmetrical about the mid-plane of said web.

9. The retaining wall according to claim 1, wherein the ratio of the thickness of said flange ends to the thickness of said web is between 1.0 and 1.7.

10. The retaining wall according to claim 1, wherein the ratio of the maximum thickness of said flange at said extra material thickness to the thickness of said flange ends is between 1.5 and 4.0.

11. The retaining wall according to claim 1, wherein the thickness of said flange ends is between 10 mm and 25 mm.

12. The retaining wall according to claim 1, wherein the maximum thickness of the flange at said extra material thickness is between 40 mm and 60 mm.

13. The retaining wall according to claim 1, wherein the ratio of the web depth to the flange width is at least equal to 2.

* * * * *